US007997108B2

(12) United States Patent
Flandrinck

(10) Patent No.: US 7,997,108 B2
(45) Date of Patent: Aug. 16, 2011

(54) RELEASABLE LOCK FOR A MOTOR VEHICLE LOCKING SYSTEM

(75) Inventor: Christian Flandrinck, Créteil Cedex (FR)

(73) Assignee: Valeo Securite Habitacle, Creteil Cedex (FR)

( * ) Notice: Subject to any disclaimer, the term of this patent is extended or adjusted under 35 U.S.C. 154(b) by 866 days.

(21) Appl. No.: 11/885,491

(22) PCT Filed: Feb. 22, 2006

(86) PCT No.: PCT/EP2006/060175

§ 371 (c)(1),
(2), (4) Date: Aug. 31, 2007

(87) PCT Pub. No.: WO2006/092371

PCT Pub. Date: Sep. 8, 2006

(65) Prior Publication Data

US 2008/0190154 A1 Aug. 14, 2008

(30) Foreign Application Priority Data

Mar. 4, 2005 (FR) ..... 05 02231

(51) Int. Cl.
*E05B 9/10* (2006.01)

(52) U.S. Cl. ..... 70/379 R; 70/419; 70/472

(58) Field of Classification Search ..... 70/379 R, 70/379 A, 380, 188–190, 222, 386, 422, 472, 70/DIG. 62, DIG. 42, 419, 360
See application file for complete search history.

(56) References Cited

U.S. PATENT DOCUMENTS

| | | | | | |
|---|---|---|---|---|---|
| 4,903,512 | A | * | 2/1990 | Leroy et al. | 70/379 R |
| 5,044,183 | A | * | 9/1991 | Neyret | 70/223 |
| 5,265,453 | A | * | 11/1993 | Konii et al. | 70/379 R |
| 5,428,978 | A | * | 7/1995 | Tsukano | 70/386 |
| 5,732,580 | A | * | 3/1998 | Garnault et al. | 70/422 |
| 5,765,417 | A | * | 6/1998 | Bolton | 70/495 |

(Continued)

FOREIGN PATENT DOCUMENTS

EP 0 943 758 A1 9/1999

(Continued)

OTHER PUBLICATIONS

International Search Report w/ English Translation for PCT/EP2006/060175 mailed Jun. 1, 2006 (4 pages).

*Primary Examiner* — Kristina R Fulton
(74) *Attorney, Agent, or Firm* — Osha • Liang LLP

(57) ABSTRACT

A disengageable cylinder for a motor vehicle lock mechanism includes a fixed stator, a sleeve, a rotor, a driver, and an indexer. The sleeve is mounted in rotation about its axis in the stator, and is fixed axially with respect to the stator. The rotor is mounted in rotation in the sleeve and is fixed axially in the sleeve. The driver is connected in translation on the rotor. The indexer, which can move axially between rest and disengagement positions, is connected in translation on the stator. When an appropriate key is inserted in the rotor, the driver couples the rotor and a cam actuator in rotation, releasing the lock. When an inappropriate key is inserted, the rotor and sleeve rotate, causing the indexer to move toward the cam actuator. Because the indexer is rotationally immovable as a result of its connection with the stator, the cam actuator cannot rotate.

16 Claims, 5 Drawing Sheets

U.S. PATENT DOCUMENTS

| | | | | |
|---|---|---|---|---|
| 6,021,654 | A * | 2/2000 | McCaa | 70/149 |
| 6,523,382 | B1 * | 2/2003 | Dimig et al. | 70/496 |
| 6,711,923 | B2 * | 3/2004 | Weyerstall | 70/379 R |
| 6,711,924 | B2 * | 3/2004 | Ritz | 70/422 |
| 6,978,645 | B2 * | 12/2005 | Shimon | 70/379 R |

FOREIGN PATENT DOCUMENTS

| | | | |
|---|---|---|---|
| FR | 2 748 513 | A | 11/1997 |
| GB | 2 005 335 | A | 4/1979 |
| WO | WO-03/106789 | A2 | 12/2003 |

* cited by examiner

RELEASABLE LOCK FOR A MOTOR VEHICLE LOCKING SYSTEM

BACKGROUND OF THE INVENTION

The invention relates to a disengageable cylinder for an automobile lock mechanism.

The addition of a disengageable mechanism to a cylinder intended for an automobile lock makes it possible to prevent this cylinder from being forced. Specifically, if an improper key, or any other flat tool of suitable shape, is inserted into the rotor, and if an attempt is then made to rotate the rotor, the disengagement mechanism enables the rotor and the intermediate sleeve to pivot freely inside the stator without considerable stresses being exerted on the tumblers.

The fact is that, in the presence of excessive stresses, the tumblers are liable to be damaged or be retracted by force, thus allowing the cylinder to be unlocked without the appropriate key.

The invention is concerned more precisely with a disengageable cylinder, in particular for a motor vehicle lock mechanism, comprising a fixed stator, a tubular intermediate sleeve which is mounted in rotation about its axis in the stator and which is fixed axially with respect to the stator, a rotor which is mounted in rotation in the sleeve, which is fixed axially in the sleeve and which comprises tumblers which can move radially under the action of a key intended to be inserted axially into the rotor. Tumblers are fully retracted inside the rotor when the key is appropriate, so as to allow a free rotation of the rotor with respect to the sleeve and the stator and thus allow a lock operating lever, called a cam actuator, to be rotated, this lever being coupled to the rotor via a driver. The rotor and the intermediate sleeve are blocked against rotation with respect to one another by the tumblers when the key is not appropriate. The cylinder also comprises an indexer which can move axially between a rest position and a disengagement position, under the effect of a rotation of the sleeve with respect to the stator subsequent to the rotor being rotated by means of an inappropriate key, so as to move the driver axially toward a disengaged position.

Such a disengageable cylinder is described in patent document FR 2 748 513.

In this known cylinder, the indexer and the driver are in a configuration with a substantially end-to-end arrangement. These two parts are substantially arranged as a continuation of one another.

The indexer is coupled in rotation with the intermediate sleeve and is guided in translation therein. The driver for its part is guided in rotation on the rotor.

The indexer comprises a main ring and guide tabs which extend axially toward the rear from the ring and which are intended to be received in corresponding axial notches of the intermediate sleeve. It also comprises two lugs which extend axially toward the front in the continuation of two diametrically opposed guide tabs.

This cylinder arrangement poses the following technical problems.

By virtue of its configuration in an end-to-end arrangement, the length of such a cylinder is relatively large.

Moreover, the indexer is a relatively fragile part on account of its construction.

BRIEF SUMMARY OF THE INVENTION

The invention solves these problems by providing a particularly compact disengageable cylinder, that is to say one with a limited length and particularly robust construction.

The invention relates to a disengageable cylinder, in particular for a motor vehicle lock mechanism, comprising a fixed stator, a tubular intermediate sleeve which is mounted in rotation about its axis in the stator and which is fixed axially with respect to the stator, a rotor which is mounted in rotation in the sleeve, which is fixed axially in the sleeve and which comprises tumblers which can move radially under the action of a key intended to be inserted axially into the rotor, the rotor and the intermediate sleeve being blocked against rotation with respect to one another by the tumblers when the key is not appropriate, a driver providing coupling between the rotor and an operating lever, called a cam actuator, when the key is appropriate, and an indexer which can move axially between a rest position and a disengagement position, under the effect of a rotation of the sleeve with respect to the stator subsequent to the rotor being rotated by means of an inappropriate key, so as to move the driver axially toward a disengaged position, characterized in that the indexer and the driver are cylindrical parts surrounding the rotor and can move while fitted one inside the other, in that the driver is connected in translation on the rotor, and in that the indexer is connected in translation in the stator.

According to a preferred embodiment, the driver can move inside the indexer.

Preferably, the driver is uncoupled from the cam actuator, in said disengaged position.

Advantageously, the driver comprises, on its edge facing the cam actuator, at least one guide lug intended to cooperate with a corresponding notch belonging to the cam actuator.

The driver may comprise, on its edge facing the key entry, at least one guide lug intended to cooperate with a corresponding notch belonging to the intermediate sleeve.

Preferably, the driver comprises a collar, two first guide lugs of trapezoidal shape, as seen in cross section through a plane tangential to the collar, which extend axially toward the key entry from the collar, and two second guide lugs of trapezoidal shape, as seen in cross section through a plane tangential to the collar, which extend axially toward the cam actuator from the collar.

Furthermore, the intermediate sleeve may comprise two notches corresponding to said first guide lugs, and the cam actuator may comprise two notches corresponding to said first guide lugs.

Preferably, the indexer is coupled in rotation with the cam actuator, in said disengaged position.

Preferably, the indexer may comprise, on its edge facing the cam actuator, at least one guide tab intended to cooperate with a corresponding notch belonging to the cam actuator.

Preferably, the indexer comprises, on its edge facing the key entry, at least one guide tab intended to cooperate with a corresponding notch belonging to the intermediate sleeve.

The indexer may comprise a main ring, two first guide tabs of trapezoidal shape, as seen in cross section through a plane tangential to the ring, which extend axially toward the key entry from the ring, and second guide tabs of trapezoidal shape, as seen in cross section through a plane tangential to the ring, which extend axially toward the cam actuator from the ring.

The intermediate sleeve may comprise two notches corresponding to said first guide tabs, and the cam actuator may comprise two notches corresponding to said first guide tabs.

The cylinder may also comprise a means for returning the cam actuator to an initial position from a transient position during the disengagement of the cylinder.

Preferably, the distance between the external bases of the guide tabs of the indexer is substantially equal to the distance between the front face of the intermediate sleeve and the bottom of the notches belonging to the cam actuator that are intended to receive said guide tabs of the indexer.

The invention is described in more detail below with the aid of figures representing only one preferred embodiment of the invention.

DETAILED DESCRIPTION OF THE INVENTION

Figure 1:
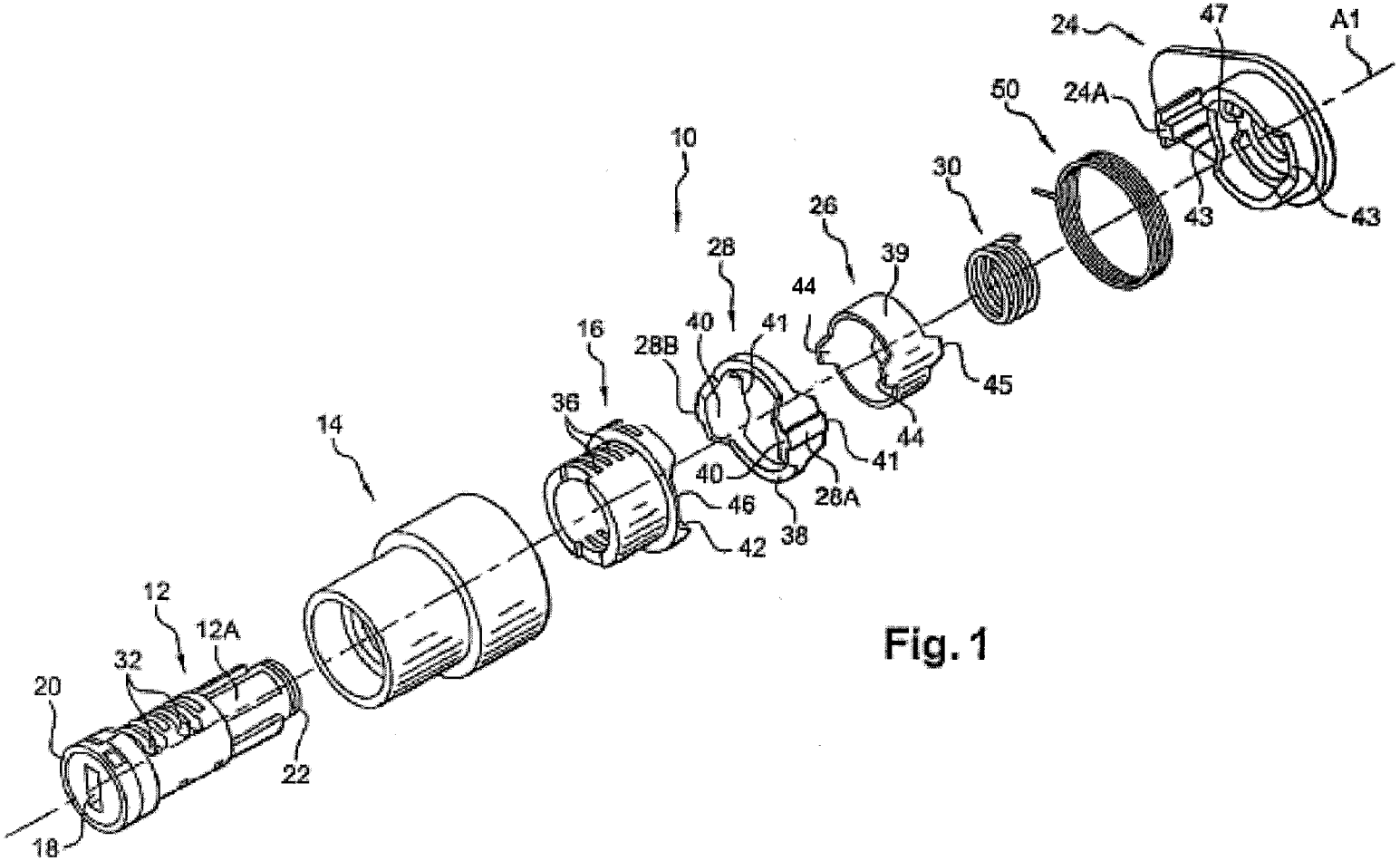
FIG. 1 is an exploded perspective view of a disengageable cylinder according to the invention.
Figure 2:
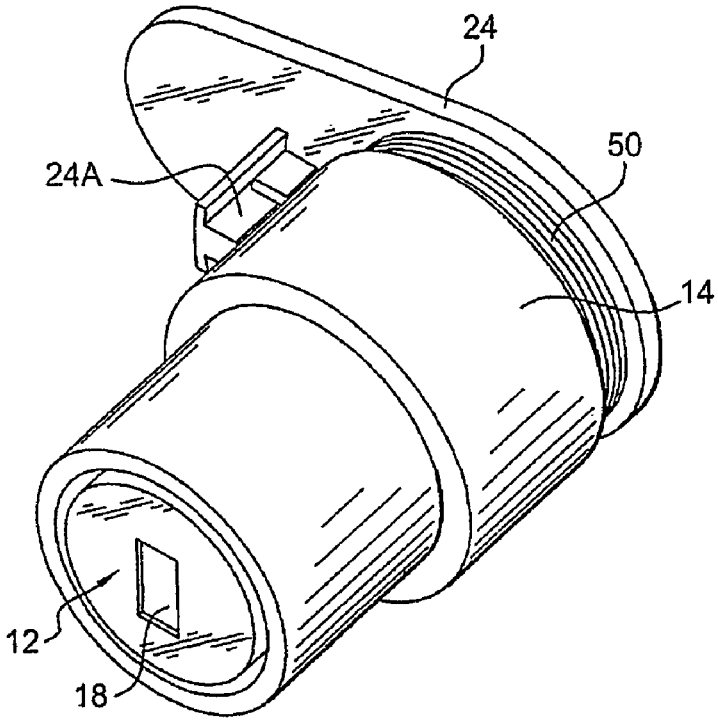
FIG. 2 is a perspective view of a cylinder according to the invention.
Figure 3:
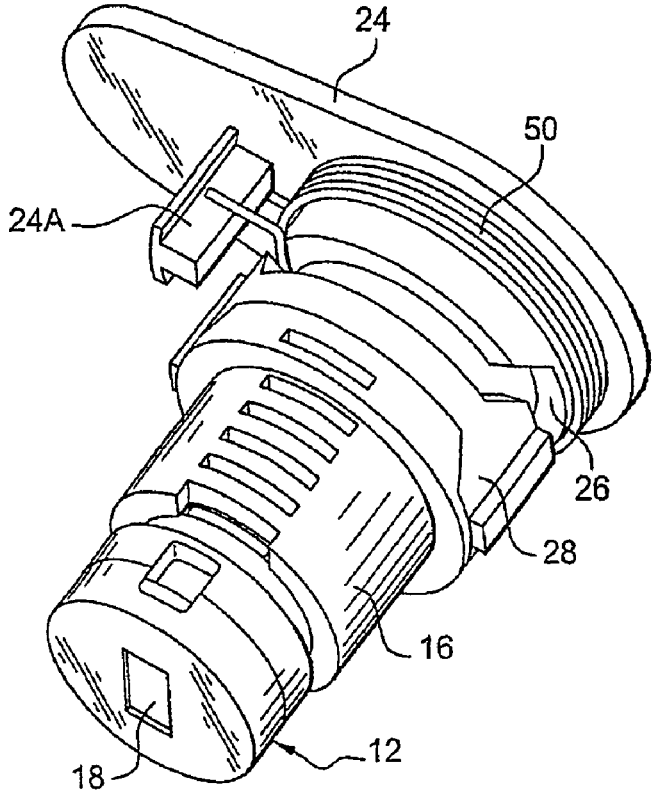
FIG. 3 is a perspective view of a cylinder according to the invention, in the engaged position, the stator not being represented.
Figure 4:
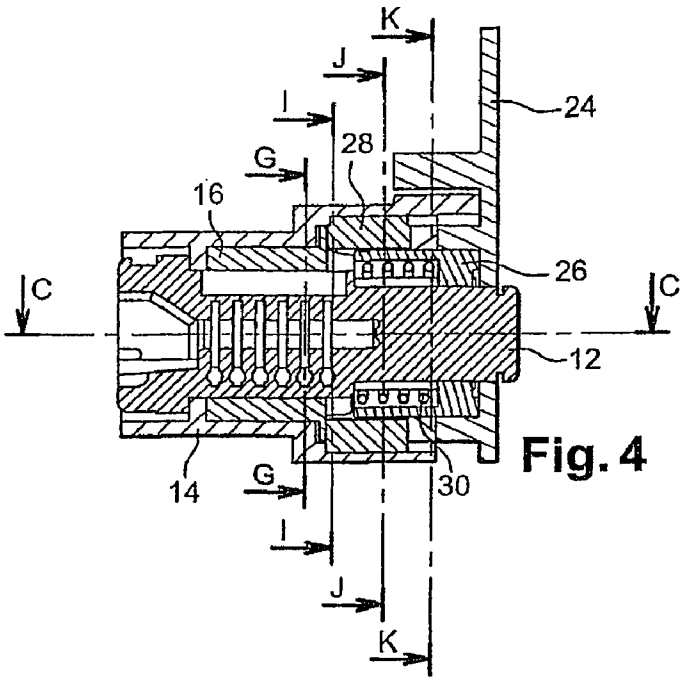
FIG. 4 is a view in longitudinal section of the disengageable cylinder according to the invention, in the engaged position.
Figure 5:
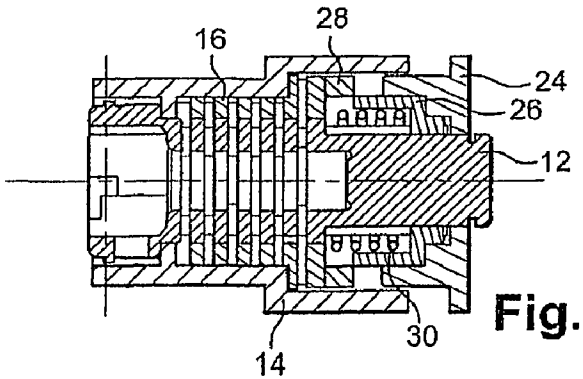
FIG. 5 is a view in longitudinal section on C in FIG. 4.
Figure 6:
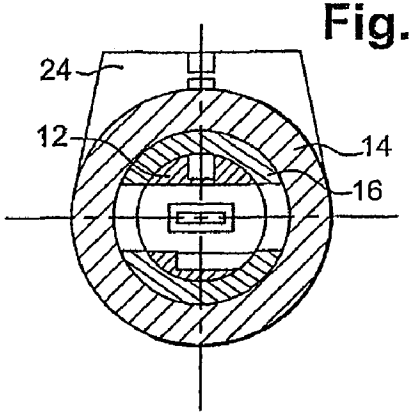
FIG. 6 is a view in cross section on G in FIG. 4.
Figure 8:
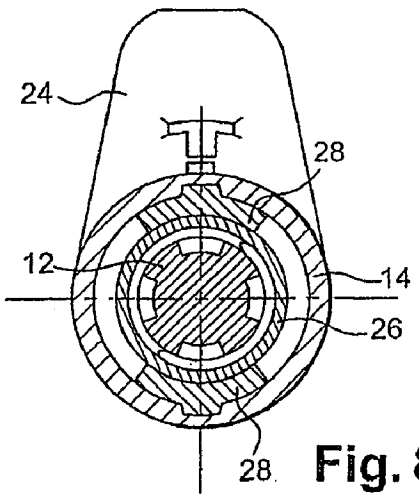
FIG. 8 is a view in cross section on J in FIG. 4.
Figure 7:
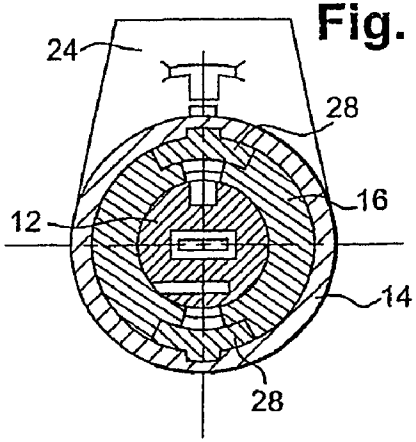
FIG. 7 is a view in cross section on I in FIG. 4.
Figure 9:
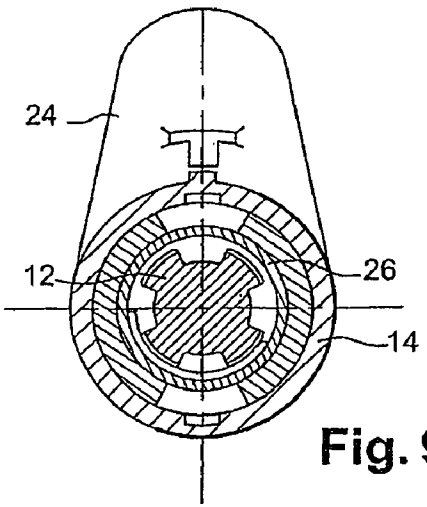
FIG. 9 is a view in cross section on K in FIG. 4.

FIGS. 1 and 2 show a rotary cylinder of longitudinal axis A1 that comprises disengagement means according to the teachings of the invention.

The cylinder 10 essentially comprises a rotor 12 which is rotatably mounted, about the axis A1, inside a fixed stator 14, with a tubular intermediate sleeve 16 being interposed between the two of them, this sleeve being mounted in rotation about its axis in the stator and being fixed axially with respect to the stator.

The rotor 12 is intended to be rotated by means of a key (not shown) inserted axially inside the rotor 12 through a key entry 18 arranged in a front transverse face 20 of the rotor 12, which face 20 is intended, for example, to be flush with the outside of a vehicle body panel (not shown).

The rear axial end 22 of the rotor 12 is intended to rotate a lever 24 which operates a lock mechanism (not shown) so as to allow the locking and unlocking of an opening leaf of the vehicle.

The rotor 12 is able to rotate the operating lever 24, only in the presence of an appropriate key, via a driver 26 which can move axially in the cylinder 10, under the action of an indexer 28, between an engaged position in which it connects the rotor 12 and the operating lever 24 in rotation, and a disengaged position in which the rotor 12 is no longer able to rotate the lever 24 and in which the indexer 28 ensures that the lever 24 is blocked against rotation with respect to the stator 14 of the cylinder 10.

The rotor 12, the stator 14 and the intermediate sleeve 16 are not able to move in translation along the axis A1 with respect to one another, and a helical compression spring 30 is interposed between the rotor 12 and the driver 26 so as to urge the latter axially rearward toward its engaged position.

The stator 14 has a cylindrical tubular general shape and it comprises means (not shown) which allow the cylinder 10 to be mounted and fastened on the vehicle.

In a known manner, the rotor 12 is intended to receive tumblers 32 arranged in transverse planes which follow one another at regular intervals in the direction of the axis A1 of the cylinder 10, these tumblers being received in corresponding housings of the rotor 12.

The tumblers 32 can move radially in the rotor 12 and they are urged elastically toward a projecting position in which they partially protrude outside the housings of the rotor 12.

However, when an appropriate key is inserted inside the rotor 12, the tumblers 32 are fully retracted radially inward into the rotor 12.

Thus, when the appropriate key is inserted into the rotor 12, the latter can pivot freely with respect to the cylindrical intermediate sleeve 16 and with respect to the stator 14.

However, if an inappropriate key, or any other tool, is inserted into the rotor 12, the tumblers 34 are not fully retracted and are received inside corresponding apertures 36 arranged in the intermediate sleeve 16. Thus, the tumblers 34 immobilize the rotor 12 in rotation with respect to the intermediate sleeve 16 which, for its part, remains free to rotate with respect to the stator 14.

The indexer 28, which can move axially between a rest position and a disengagement position, is connected in translation on the stator 14 via grooves arranged inside the stator and via ribs 28A, 28B which slide inside these grooves. The ribs 28A, 28B and the grooves are two in number and are diametrically opposed.

The indexer 28 particularly comprises a main ring 38 and first guide tabs 40 of trapezoidal shape, as seen in cross section through a plane tangential to the ring 38, which extend axially toward the front from the ring 38. These first tabs 40 are intended to be received in corresponding axial notches 42 of the intermediate sleeve 16. These first guide tabs 40 are two in number and are diametrically opposed on the ring 38.

The notches 42 open out axially toward the front in the rear axial end of the sleeve 16 such that, together with the guide tabs 40, they make it possible to rotationally connect the indexer 28 with the intermediate sleeve 16, while still allowing the possibility for the indexer 28 to move axially in the cylinder 10.

The indexer also comprises second guide tabs 41 of trapezoidal shape, as seen in cross section through a plane tangential to the ring 38, which extend axially toward the rear from the ring 38. These second tabs 41 are intended to be received in corresponding axial notches 43 of the cam actuator 24. These second guide tabs 41 are two in number, are diametrically opposed on the ring 38 and are arranged substantially opposite the first guide tabs 40.

The driver 26 provides coupling between the rotor 12 and the cam actuator 24 when the key is appropriate. It is connected in translation on the rotor via internal ribs and via grooves 12A belonging to the rotor 12.

The driver 26 comprises a collar 39 whose inside diameter is slightly larger than the outside diameter of the ring 38 of the indexer 28, so as to allow the driver to be guided in a sliding manner around the indexer.

The driver 26 comprises first guide lugs 44 of trapezoidal shape, as seen in cross section through a plane tangential to the collar 39, which extend axially toward the front from the collar 39. These first lugs 44 are intended to be received in corresponding axial notches 46 of the intermediate sleeve 16.

These first guide lugs 44 are two in number and are diametrically opposed on the collar 39.

These notches 46 open out axially toward the front in the rear axial end of the sleeve 16 such that, together with the first guide lugs 44, they make it possible to rotationally connect the driver 26 with the intermediate sleeve 16, while still allowing the possibility for the driver to move axially in the cylinder 10.

The driver 26 also comprises second guide lugs 45 of trapezoidal shape, as seen in cross section through a plane tangential to the collar 39, which extend axially toward the rear from the collar 39. These second lugs 45 are intended to be received in corresponding axial notches 47 of the cam actuator 24. These second guide lugs 45 are two in number, are diametrically opposed on the collar 39 and are arranged substantially opposite the first guide lugs 44.

The cylinder 10 also comprises a return spring 50 which operates in torsion and which serves to return the cam actuator 24 to the initial position.

The operation of the cylinder according to the invention will now be described with reference to the other figures.

In FIGS. 3 to 9, an appropriate key has been inserted into the rotor 12 through the key entry 18, and the cylinder is thus in the engaged position. The tumblers 32 are thus retracted inside the rotor 12, which can turn in the intermediate sleeve 16.

In this position, the rotor 12 can be turned with the key and drives the driver 26 along with it, this driver, by virtue of its lugs 45 fitting into the corresponding notches 47 of the cam actuator 24, causing said actuator to rotate, releasing the lock.

The other parts remain immovable, more precisely the intermediate sleeve 16, which is rotationally immovable, and the indexer 28 fitted into said sleeve by its front guide tabs 40.

The rotation of the cam actuator 24 is obtained by the rotation of the following parts: key/rotor/driver/cam actuator.

At the end of travel, when the key is released, the return spring 50, whose one end is fixed and other end butts against a lug 24A of the cam actuator 24, returns the cam actuator to the initial position along with the driver and the rotor.

Figure 10:
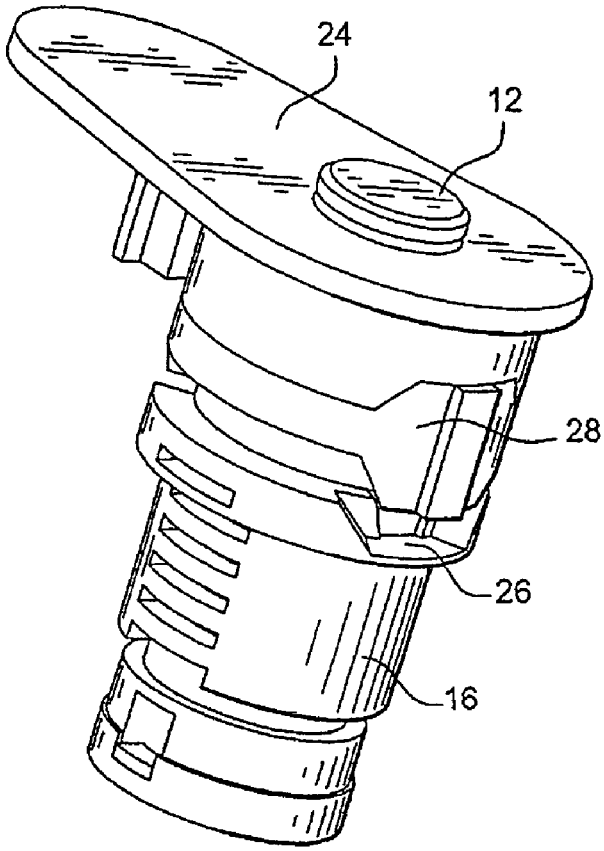
FIG. 10 is a perspective view of a cylinder according to the invention, in the disengaged position, the stator not being represented.
Figure 11:
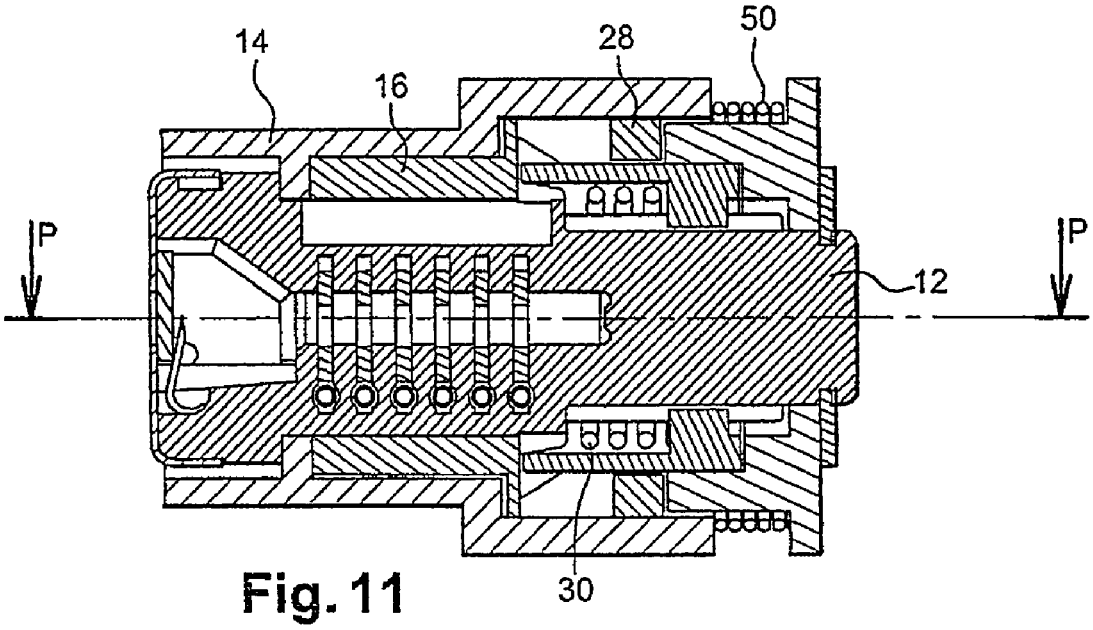
FIG. 11 is a view in longitudinal section of the disengageable cylinder according to the invention, in the disengaged position.
Figure 12:
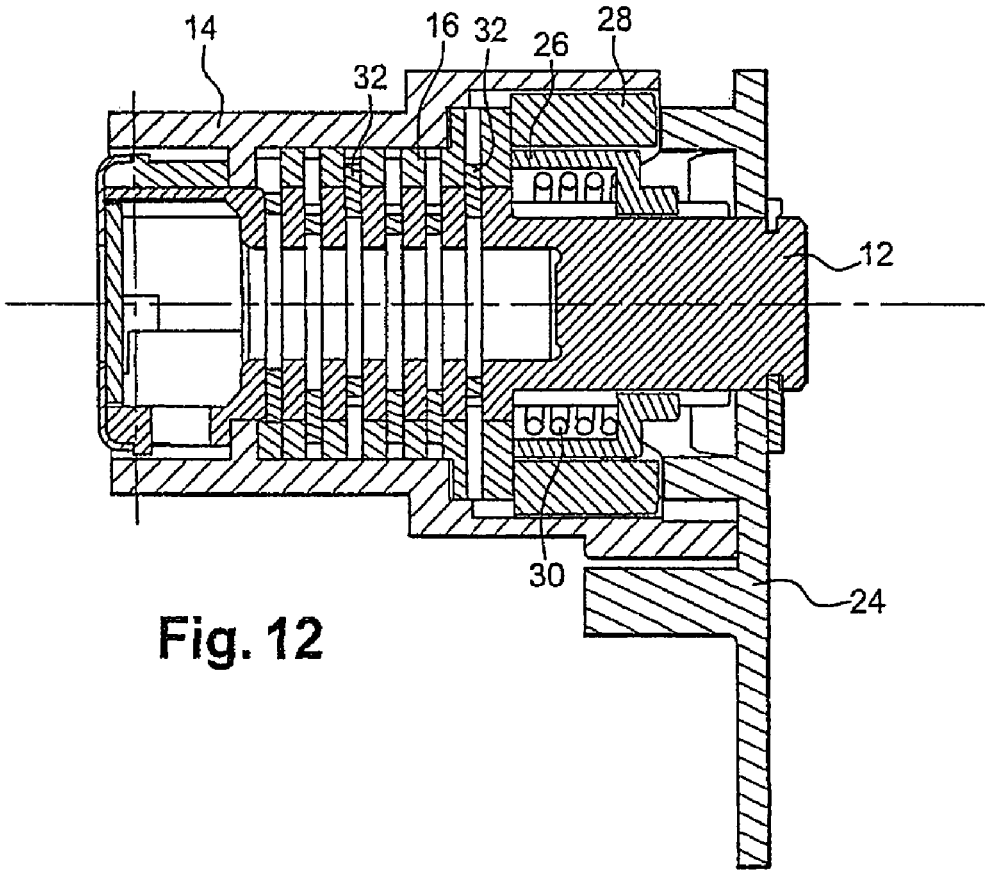
FIG. 12 is a view in longitudinal section on P in FIG. 11.

In FIGS. 10 to 12, an inappropriate key has been inserted into the rotor 12 through the key entry 18, and the cylinder is thus in the disengaged position. The tumblers 32 are thus not retracted inside the rotor 12, which is consequently rotationally connected to the intermediate sleeve 16 as a result of the tumblers being inserted in the latter.

The rotation of the inappropriate key thus causes the interconnected rotor 12 and intermediate sleeve 16 to be rotated. The rotation of the sleeve 16 results in the translation of the indexer 28 in the direction of the cam actuator 24 by virtue of the front guide tabs 40 of the indexer sliding out of the corresponding notches 42 of the sleeve 16. In this translated position, the rear guide tabs 41 of the indexer 28 become inserted in the corresponding notches 43 of the cam actuator 24. Since the indexer 28 is rotationally immovable as a result of its connection with the stator, the cam actuator cannot turn.

The driver 26 for its part is uncoupled from the cam actuator 24 since, given that it is turned with the rotor 12, its rear lugs 45 slide on the cam actuator and come out of the corresponding notches, which results in its translation in the direction of the key under the effect of the disengagement spring 30. Its front lugs 44 become inserted in the corresponding notches 46 of the intermediate sleeve 16.

The deliberate rotation of the key thus results in the movement of the following parts: rotation of the rotor/rotation of the intermediate sleeve/translation of the indexer and blocking of the cam actuator against rotation/rotation of the driver and uncoupling of the cam actuator and connection with the intermediate sleeve.

On completion of these movements, when the key is released, the compression spring 30 pushes away the driver 26 against the cam actuator, obliging the rotor 12 to return to the initial position as a result of the rear lugs 45 sliding against the face of the corresponding notches 47 until these lugs and notches are inserted one within the other. When returning to its initial position, the rotor 12 as it turns takes with it the intermediate sleeve 16, which receives the front guide tabs 40 of the indexer 28.

Figure 13:
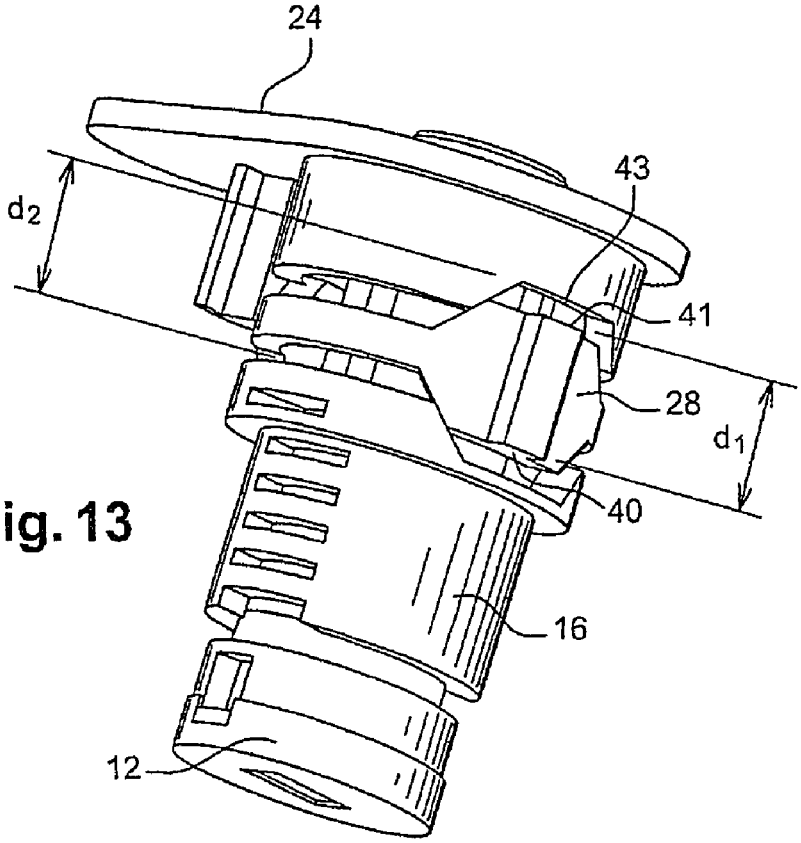
FIG. 13 is a perspective view of a cylinder according to the invention, in a transient position, i.e., between the engaged and disengaged positions, the stator not being represented.

FIG. 13 illustrates another feature of the invention which has been deliberately ignored above for the purposes of clarity and simplification.

This figure illustrates a transient position during the blocking of the cam actuator 24 by the indexer 28, before arriving at the disengaged position as represented in FIG. 10.

The distance d1 between the external bases of the guide tabs 40, 41 of the indexer 28 is substantially equal to the distance d2 between the front face of the intermediate sleeve 16 and the bottom of the notches 43 belonging to the cam actuator. It is thus ensured that these tabs 41 fit into the notches 43 from the start of the translation of the indexer 28.

The passage of the indexer 28 from its rest position, in which its guide tabs 40 are mating with the corresponding notches of the intermediate sleeve 16, to its disengagement position, in which its guide tabs 41 are mating with the corresponding notches of the cam actuator 24, occurs simultaneously with the movement of the driver 26 in an opposite direction, from its rest position, in which its guide lugs 45 are mating with the corresponding notches of the cam actuator 24, to its disengagement position in which its guide lugs 44 are mating with the corresponding notches of the intermediate sleeve 16. Up until the transient position, the driver 26 rotates the cam actuator 24 over a certain opening angle before the cam actuator is effectively blocked in this rotation by the indexer 28 in this transient position represented in FIG. 13.

Due to the trapezoidal shape of the notches 43 belonging to the cam actuator 24, the movement of the indexer 28 toward the cam actuator subsequent to this transient position pushes the cam actuator to rotate in the opposite direction until it reaches its rest position. The cam actuator is thus returned to the rest position during the disengagement of the cylinder.

The invention claimed is:

1. A disengageable cylinder for a motor vehicle lock mechanism, comprising:

a fixed stator;

a tubular intermediate sleeve which is mounted in rotation about its axis in the stator and which is fixed axially with respect to the stator;

a rotor which is mounted in rotation in the sleeve, which is fixed axially in the sleeve and which comprises tumblers which can move radially under the action of a key intended to be inserted axially into the rotor, the rotor and the intermediate sleeve being blocked against rotation with respect to one another by the tumblers when the key is not appropriate;

a driver providing a coupling between the rotor and a cam actuator, when the key is appropriate; and an indexer which can move axially between a rest position and a disengagement position and which is rotationally immovable, under the effect of a rotation of the sleeve with respect to the stator subsequent to the rotor being rotated by means of an inappropriate key, so as to move the driver axially toward a disengaged position, wherein the indexer and the driver are cylindrical parts surrounding the rotor and can move while fitted one inside the other, in that the driver is connected in translation on the rotor, wherein the indexer is connected in translation in the stator, and wherein the rotationally immovable indexer is coupled in rotation with the cam actuator in said disengaged position, thereby blocking the cam actuator from rotation in said disengaged position.

2. The cylinder as claimed in claim 1, wherein the driver is configured to move inside the indexer.

3. The cylinder as claimed in claim 1, wherein the driver is uncoupled from the cam actuator, in said disengaged position.

4. The cylinder as claimed in claim 3, wherein the driver comprises, on its edge facing the cam actuator, at least one first guide lug intended to cooperate with a corresponding notch belonging to the cam actuator.

5. The cylinder as claimed in claim 4, wherein the driver comprises, on an edge facing a key entry, at least one second guide lug intended to cooperate with a corresponding notch belonging to the intermediate sleeve.

6. The cylinder as claimed in claim 5, wherein the driver comprises a collar, two first guide lugs of trapezoidal shape, as seen in cross section through a plane tangential to the collar, which extend axially toward the key entry from the collar, and two second guide lugs of trapezoidal shape, as seen in cross section through a plane tangential to the collar, which extend axially toward the cam actuator from the collar.

7. The cylinder as claimed in claim 6, wherein the intermediate sleeve comprises two notches corresponding to said first guide lugs, and the cam actuator comprises two notches corresponding to said second guide lugs.

8. The cylinder as claimed in claim 1, wherein the indexer comprises, on an edge facing the cam actuator, at least one first guide tab intended to cooperate with a corresponding notch belonging to the cam actuator.

9. The cylinder as claimed in claim 8, wherein the indexer comprises, on an edge facing a key entry, at least one second guide tab intended to cooperate with a corresponding notch belonging to the intermediate sleeve.

10. The cylinder as claimed in claim 9, wherein the indexer comprises a main ring, two first guide tabs of trapezoidal shape, as seen in cross section through a plane tangential to the ring, which extend axially toward the key entry from the ring, and two second guide tabs of trapezoidal shape, as seen in cross section through a plane tangential to the ring, which extend axially toward the cam actuator from the ring.

11. The cylinder as claimed in claim 10, wherein the intermediate sleeve comprises two notches corresponding to said first guide tabs, and the cam actuator comprises two notches corresponding to said second guide tabs.

12. The cylinder as claimed in claim 1, wherein the cylinder comprises a means for returning the cam actuator from a transient position located between the engaged and the disengaged positions to an initial position, which the cam actuator previously occupied, during the disengagement of the cylinder.

13. The cylinder as claimed in claim 10, wherein a distance between external bases of the guide tabs of the indexer is substantially equal to a distance between a front face of the intermediate sleeve and a bottom of the notches belonging to the cam actuator that are intended to receive said guide tabs of the indexer.

14. The cylinder as claimed in claim 2 wherein the driver is uncoupled from the cam actuator, in said disengaged position.

15. The cylinder as claimed in claim 11, wherein a distance between external bases of the guide tabs of the indexer is substantially equal to a distance between a front face of the intermediate sleeve and a bottom of the notches belonging to the cam actuator that are intended to receive said guide tabs of the indexer.

16. The cylinder as claimed in claim 12, wherein a distance between the external bases of the guide tabs of the indexer is substantially equal to a distance between a front face of the intermediate sleeve and a bottom of the notches belonging to the cam actuator that are intended to receive said guide tabs of the indexer.

* * * * *